US005478448A

United States Patent [19]

Schneider

[11] Patent Number: 5,478,448

[45] Date of Patent: Dec. 26, 1995

[54] PROCESS AND APPARATUS FOR REGENERATING AN AQUEOUS SOLUTION CONTAINING METAL IONS AND SULFURIC ACID

[75] Inventor: Lothar Schneider, Wächtersbach, Germany

[73] Assignee: Heraeus Elektrochemie GmbH, Hanau, Germany

[21] Appl. No.: 270,164

[22] Filed: Jul. 1, 1994

[30] Foreign Application Priority Data

Aug. 11, 1993 [DE] Germany ..... 43 26 854.4

[51] Int. Cl.[6] ..... C23G 1/36

[52] U.S. Cl. ..... 204/104; 204/105 R; 204/108; 204/112; 204/115; 204/119

[58] Field of Search ..... 204/105 R, 108, 204/112, 115, 119, 104, 263, 264, 266, 275, 276, 278

[56] References Cited

U.S. PATENT DOCUMENTS

| | | | |
|---|---|---|---|
| 2,810,686 | 10/1957 | Bodamer | 204/130 |
| 4,073,709 | 2/1978 | Schneider | 204/113 |
| 4,973,380 | 11/1990 | Pryor et al. | 204/130 |

FOREIGN PATENT DOCUMENTS

| | | |
|---|---|---|
| 435382 | 7/1991 | European Pat. Off. . |
| 1273486 | 5/1972 | United Kingdom . |
| 9306262 | 4/1993 | WIPO . |

OTHER PUBLICATIONS

Bramer, H. C., Electrolytic Regeneration of Spent Pickling Solutions, Ind. 2nd Engr. Chemistry vol. 47 No. 1 (1955) pp. 67–70 (no month).

Chemical Abstracts, vol. 84, No. 16, Abstract No. 84: 109068p (1976) (no month).

*Primary Examiner*—John Niebling
*Assistant Examiner*—Arun S. Phasge
*Attorney, Agent, or Firm*—Felfe & Lynch

[57] ABSTRACT

An aqueous solution containing metal ions and sulfuric acid, especially a solution containing zinc ions, iron ions and/or copper ions, is placed for the cathodic precipitation of the metal ions into the anolyte chamber of an electrolysis cell divided by a cation exchanger membrane. Due to the voltage applied to the electrodes, metal ions and hydrogen ions migrate from the anolyte through the cation exchange membranes into the catholyte chamber and are there discharged, the sulfuric acid concentration in the anolyte being constantly elevated by anodic formation of protons. The regeneration can be used as an intermediate step of a chlorine gas-free regeneration of etching or extraction solutions.

7 Claims, 2 Drawing Sheets

PROCESS AND APPARATUS FOR REGENERATING AN AQUEOUS SOLUTION CONTAINING METAL IONS AND SULFURIC ACID

BACKGROUND OF THE INVENTION

The invention relates to a process for regenerating an aqueous solution containing metal ions and sulfuric acid, especially a solution containing zinc ions, nickel ions, iron ions and/or copper ions, in an electrolytic cell, wherein the metal ions are precipitated on the surface of the cathode and oxygen and protons are formed at the anode by hydrolysis, and regenerated solution can be returned to a preceding etching process or extraction process, as well as to an apparatus.

A disclosure is made in the textbook, "Praktische Galvanotechnik," published by Leuze Verlag of Saulgau/Wurttemberg, 1970, pages 537–538, of precipitating zinc out of sulfate electrolytes. Such sulfate electrolytes form in the conversion of zinc chloride solutions into zinc sulfate solutions by ion exchange methods, in which this preliminary step is intended to avoid any electrolytic treatment of chloride electrolytes because chlorine would be formed in the electrolytic treatment of zinc chloride electrolytes and would entail a considerable hazard.

Such a direct regeneration of a zinc chloride solution is disclosed in U.S. Pat. No. 4,073,709, according to which the solution containing chloride ions is introduced into a cathode chamber in an electrolysis cell which is divided into three chambers, namely an anode chamber, a cathode chamber, and an electrolyte chamber arranged therebetween. The anode chamber is defined by a porous membrane of low permeability which separates the anolyte from the electrolyte, the anolyte containing sulfuric acid. The anolyte contains a substance which is capable of binding to the chloride ions that enter the anode chamber and thus prevent oxidation of chloride ions at the anode. The liquid level of the anolyte is always maintained, by adding anolyte if necessary, so that the level is above the liquid level of the adjacent electrolyte for the purpose of sustaining the desired rate of flow through the membrane to achieve the technical purpose. In order to prevent any chloride ions that might seep through the anode membrane from being oxidized to chlorine gas, the anolyte contains a silver sulfate additive so as to assure the precipitation of the chloride as silver chloride.

The relatively complicated division of the electrolyte chamber into three chambers has been found problematical, as well as the use of membranes whose permeability can vary greatly in the course of the electrolytic process. Other problems can be seen in the addition of the silver sulfate chemical, in the formation of silver chloride and its removal from the cell, and in the danger of membrane clogging by silver chloride precipitates.

Furthermore, in the book, "Angewandte Elektrochemie," by A . Schmidt, Verlag Chemie Weinheim 1976, on page 210, requirements are given according to which zinc, in spite of its electronegative standard potential of –0.763 V, can be precipitated owing to the high overtension of the hydrogen on the zinc; it is stated that for the precipitation of zinc a relatively high zinc ion concentration is necessary at the cathode, since otherwise, due to the increasing sulfuric acid concentration, after a certain time hydrogen would separate instead of zinc. On page 213 of the same book various examples of zinc electrolysis methods are given.

EP 0 435 382 discloses an electrolysis process for treating old etchants containing metal ions. The cathode and anode chambers are separated from one another by an anion exchanger membrane, and the anode chamber is filled with a demetallized oxidizable or nonoxidizable etching solution. The freely chosen potential of the cathode or anode is kept constant by means of a voltage-regulated rectifier through a reference electrode; the metal ions are precipitated at the cathode and the regenerated acid concentrated in the anode chamber is returned to the etching bath.

However, no information can be found in EP 0 435 382 on the treatment of a solution containing metal ions with a sulfuric acid concentration that ranges from 60 to 80 grams per liter for an etching solution in need of regeneration.

SUMMARY OF THE INVENTION

According to the invention sulfuric acid etching or extracting solutions heavily loaded with metal ions can be thoroughly demetallized, at the same time yielding a pure, highly concentrated sulfuric acid. At the same time the cathodic separation of hydrogen, such as can occur especially in aqueous solutions with a relatively low metal ion concentration, is to be reliably prevented.

The process is to be used as an intermediate step in a chlorine gas-free regeneration of etching or extracting solutions.

Furthermore, an apparatus is described for the regeneration of an aqueous solution containing metal ions and sulfuric acid in an electrolysis cell having at least one anode and one cathode, in which the electrolysis cell is divided by an ion exchanger membrane into an anolyte chamber and a catholyte chamber, the catholyte chamber has at least one opening for the entry and exit of the solution containing metal ions, and the anolyte chamber has at least one opening for the entry and exit of the regenerated solution.

The solution containing the metal ions is fed as anolyte with a sulfuric acid concentration ranging from 60 to 80 g/1 into an electrolysis cell divided by a cation exchanger membrane stable against sulfuric acid, and the cathodic precipitation is performed at a current density ranging from 50 to 2500 A/m$^2$. Cations migrate as metal ions and hydrogen ions from the anolyte through the cation exchanger membrane into the catholyte on account of the voltage present at the electrodes and are discharged, while the sulfuric acid concentration in the anolyte is steadily increased by the anodic formation of protons.

In a preferred embodiment of the process, the sulfuric acid of increased concentration is removed from the anolyte.

An important advantage of the process is that the sulfuric acid of increased concentration can be fed back into the etching or extraction process as a fresh component of the solution, in a kind of recycling, and that the cathodically precipitated metal can also be recycled.

The process can be operated either batch-wise or continuously. In batch operation a solution is fed in as catholyte, in which the sulfuric acid concentration is the same as the initial concentration in the anolyte. If, however, the solution is continuously fed in as catholyte, its sulfuric acid concentration must, as a rule, always be below the sulfuric acid concentration of the anolyte. After a given thickness of the metal precipitate is reached, the cathode is removed from the catholyte chamber. It is also possible, however, to remove the precipitated metal from the cathode mechanically and remove from the cell the granules thus obtained.

The ion exchange membrane is configured as a cation exchange membrane and is stable against sulfuric acid, and metal precipitated at the cathode can be removed from the cell.

The process according to the invention is used preferably as a follow-up operation in an etching or extraction process in which, in a first step, a solution containing chloride ions is converted by ion exchange methods to a solution containing sulfate ions.

An important advantage of the invention is to be seen in the fact that the metal can be precipitated from a sulfate solution containing metal ions, in a simple, cost-effective manner, while at the same time a continual increase is achieved in the concentration of the sulfuric acid, which is recycled to continue the regeneration process.

DETAILED DESCRIPTION OF THE PREFERRED EMBODIMENT

Figure 1:
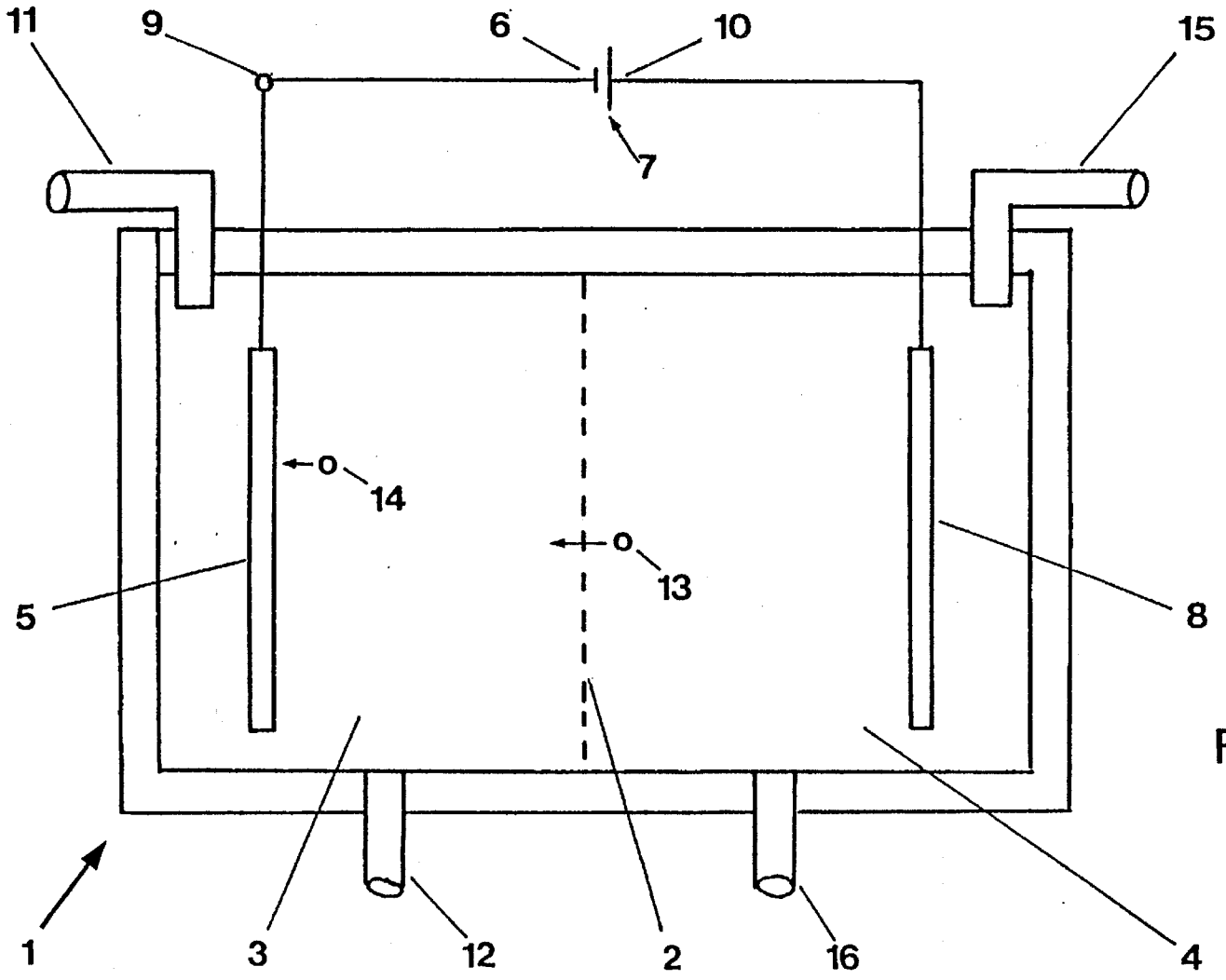
FIG. 1 shows schematically a longitudinal section through an electrolysis cell.

Referring to FIG. 1, the electrolysis apparatus has a tank 1 whose interior is divided by a cation exchange membrane 2 into a catholyte chamber 3 and an anolyte chamber 4. The anode 8 in the anolyte chamber 4 consists of a dimensionally stable valve metal electrode, especially a titanium electrode, which is connected to the positive pole 10 of a direct-current source 7. The principle of the design of such dimensionally stable valve metal electrodes, especially titanium electrodes, is known in chloralkali electrolysis, and described for example in DE-OS 20 41 250.

The cathode 5 in the catholyte chamber 3 consists of expanded copper metal; it is connected through a removable electrical terminal 9 to the negative pole 6 of the direct-current voltage source 7. In the catholyte chamber 3 is an aqueous sulfuric acid solution, which when the process starts is fed through line 11 to produce the ion conduction. Water is added as needed during the electrolysis process, and the additionally forming sulfuric acid is removed through the outlet 12 of the catholyte chamber and fed back into the regeneration process, which is for example an etching procedure.

The sulfate solution containing zinc ions is fed, continuously for example, through line 15 to the anolyte chamber 4, wherein the sulfuric acid concentration in the anolyte amounts in practice to no more than that of the catholyte. The sulfuric acid concentration of the anolyte is in the neighborhood of 70 g/1. After the anolyte and catholyte chambers are filled the electrolysis process begins. When a voltage is applied by the voltage source 7, the charge moves during the electrolysis through the ion exchanger membrane 2 by means of the cations, which are indicated symbolically with reference number 13. The zinc ions are indicated symbolically by the reference number 14 and are discharged at the cathode 5, and metallic zinc is precipitated.

In the anolyte chamber 4 the dissociation of water takes place, the oxygen being carried away as gas from the open-topped tank 1 and the hydrogen ions together with the sulfate ions are recombined to sulfuric acid, the concentration of which is raised in the course of the electrolysis process, and it exits through outlet 16 to the etching process. The sulfuric acid concentration of the catholyte is adjusted with the aid of pH meters and a control circuit which, by removing the more concentrated sulfuric acid and feeding in water through line 11, sustains the given sulfuric acid concentration or adapts it to the sulfuric acid concentration of the anolyte. The anolyte fed in as etching solution has a zinc ion concentration of about 170 g/l and a sulfuric acid concentration of around 70 g/l. The cathode 5 is made in the form of a copper-titanium or vanadium expanded metal mesh, while the anode 8 consists of the above-mentioned dimensionally stable titanium anode. Zinc is put onto the cathode 5 in a solid precipitate quality; it is also possible, however, to precipitate the zinc in dendritic form and then remove it from the cell tank. The current density of the cathode ranges from 50 to 2500 A/m$^2$. The same electrolysis apparatus is used to advantage for a batch operation, wherein the catholyte is continuously maintained within specific concentration ranges, while the anolyte side is replenished batch-wise.

Figure 2:
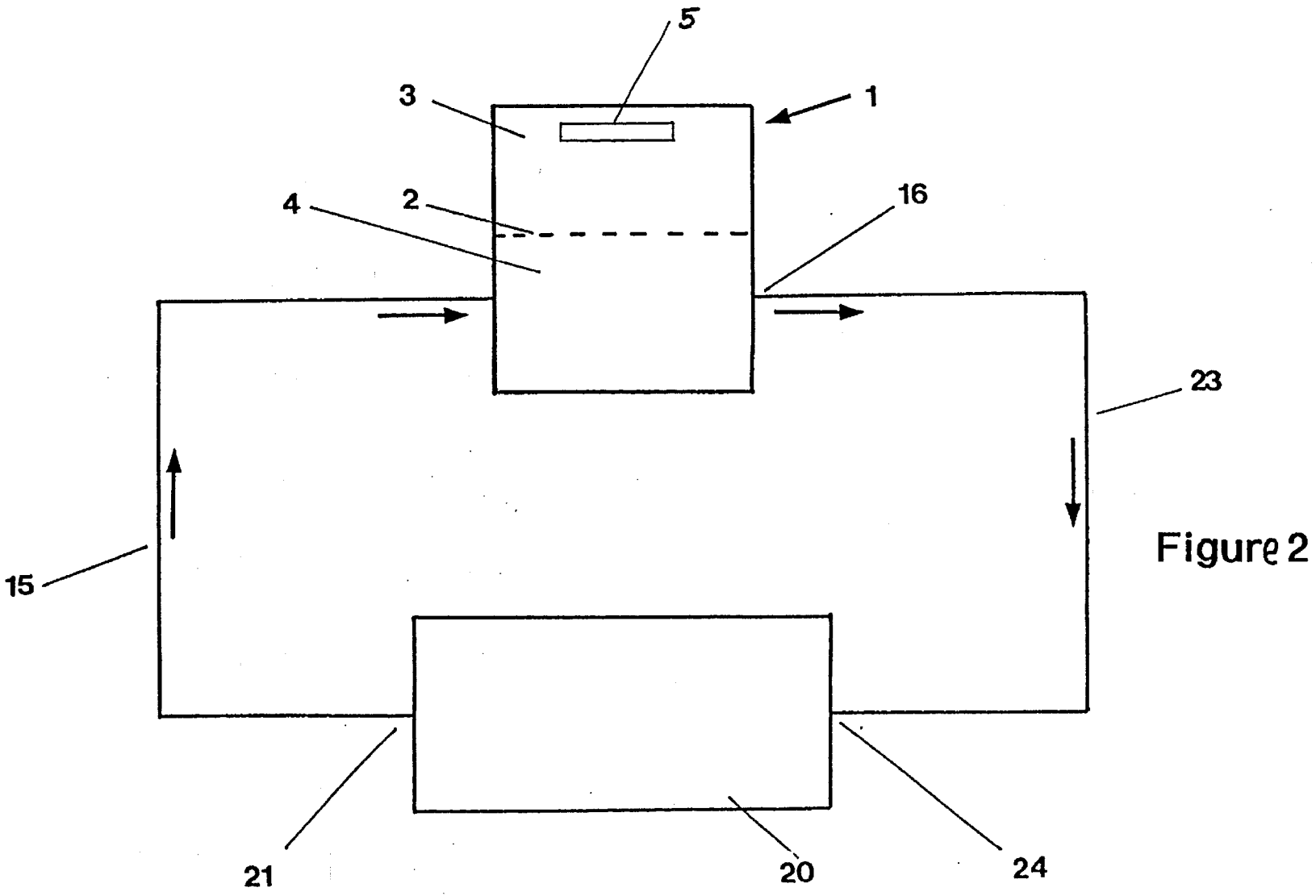
FIG. 2 is a diagram of how the process operates in the form of a circuit.

According to FIG. 2, the sulfate solution containing zinc ions and flowing from the outlet 21 of an etching apparatus 20 is fed through line 15 to the anolyte chamber 4 of the one tank 1 that contains the electrolysis cell having the ion exchanger membrane, while the zinc precipitated at cathode 5 is taken out of the catholyte chamber 3. The aqueous sulfuric acid solution of increased concentration forming in the anolyte chamber 4 is fed through outlet 16 and line 23 as fresh component for the etching process through inlet 24 of the etching apparatus 20.

FIG. 2 shows how the solution containing sulfuric acid circulates according to the process; the used etching solution is fed as an aqueous sulfate solution containing metal ions through outlet 21 of the etching apparatus 20 and line 15 to the anolyte chamber 4 of the cell, while the virtually pure sulfuric acid of increased concentration is fed back through line 23 to the etching process.

The precipitated zinc is collected from this continuously circulating process by removing it from the cell, and it can also be recycled. A membrane of the type named NAFION supplied by Dupont is used as the cation exchanger membrane.

I claim:

1. Process for the regeneration of an aqueous solution containing metal ions and sulfuric acid, said process comprising the following steps:

providing an electrolytic cell divided by a cation exchange membrane stable against sulfuric acid into an anolyte chamber containing an anode in an aqueous sulfuric acid solution and a catholyte chamber containing a cathode in an aqueous sulfuric acid solution, feeding a solution having metal cations and a sulfuric acid concentration of 60 to 80 g/l to said anolyte chamber, and applying voltage between the anode and cathode and a current density at the cathode of 50 to 2500 A/m$^2$, whereby said cations migrate through said ion exchange membrane and precipitate at said cathode as metal, and sulfuric acid is generated in the anolyte by formation of protons at said anode.

2. Process according to claim 1 wherein sulfuric acid is removed from the anolyte so that the concentration of sulfuric acid in the anolyte remains constant.

3. Process according to claim 1 wherein the aqueous sulfuric acid solution in the catholyte chamber is continuously maintained within a specific concentration range and the anolyte chamber is replenished batchwise with a solution of like sulfuric acid concentration.

4. Process according to claim 1 wherein a solution whose sulfuric acid concentration is always below the sulfuric acid concentration of the catholyte is fed continuously as anolyte to the electrolysis cell.

5. Process according to claims 1 wherein the cathodic metal precipitate is removed from the cell after a given amount is reached.

6. Process according to claim 5 wherein the cathode is removed from the cell after reaching a given thickness of the layer of the metal precipitate.

7. Process according to claim 5 wherein the metal precipitate is removed from the cell after separation from the cathode.

* * * * *